US005368505A

United States Patent [19]

Hoolhorst et al.

[11] Patent Number: 5,368,505

[45] Date of Patent: Nov. 29, 1994

[54] CABLE PLUG FOR MULTI-LEAD CABLES

[75] Inventors: Albert Hoolhorst, Aardenburg; Jacques Longueville, Oostkamp, both of

[73] Assignee: Siemens Aktiengesellschaft, Munich, Germany

[21] Appl. No.: 145,464

[22] Filed: Oct. 29, 1993

[30] Foreign Application Priority Data

Oct. 29, 1992 [DE] Germany ..... 9214719
Aug. 6, 1993 [DE] Germany ..... 9311781

[51] Int. Cl.[5] ..... H01R 13/502
[52] U.S. Cl. ..... 439/701; 439/470
[58] Field of Search ..... 439/607, 610, 470, 701

[56] References Cited

U.S. PATENT DOCUMENTS 3,072,340 1/1963 Dean ..... 439/701 X
3,447,036 5/1969 Dore et al. ..... 439/701 X
4,550,960 11/1985 Asick et al. .

FOREIGN PATENT DOCUMENTS 9207674 10/1992 Germany .

OTHER PUBLICATIONS

Siemens Plug Connector Data Book 1992, "Mounting System ES902C".

*Primary Examiner*—Khiem Nguyen
*Attorney, Agent, or Firm*—Herbert L. Lerner; Laurence A. Greenberg

[57] ABSTRACT

A cable plug is provided for connecting a multiplicity of cable leads to a modular plug, which is formed of a plurality of plate-like contact carriers being pre-fitted with IDC contacts. The contact carriers are fitted in succession onto the cable leads and are stacked on one another to form a contact block. The contact block can be inserted in a contact block casing formed of two insulating parts and locked in a particularly conducting plug housing being formed, for example, of two half-shells. The invention is suitable for connecting multi-lead cables to cable plugs, especially to shielded cable plugs.

13 Claims, 5 Drawing Sheets

CABLE PLUG FOR MULTI-LEAD CABLES

BACKGROUND OF THE INVENTION

Field of the Invention

The invention relates to a cable plug for multi-lead cables, having a plug housing which in particular is constructed to be conductive, a device for connecting a cable, and a multi-part modular plug inserted into the plug housing, the individual parts of the plug are made of insulating material, act as contact carriers and are provided with contacts disposed in rows for connecting the individual cable leads.

One such cable plug is shown on page 3.56 of Siemens-Steckverbinder-Datenbuch 1992 [1992 Siemens Plug Connector Manual]. That cable plug has a plug housing which is put together from two sheet-metal half-shells, into which a modulator plug is inserted for connecting the cable leads. The modulator plug includes two contact carriers. The contacts for connecting the cable leads are each inserted back to back in a two-row contact carrier. In cable plugs with more than two rows, the contact carriers are installed lying next to one another so that the contacts of two contact carriers face one another. In that case, an insulator strip for separation and contact securing is placed between the two contact carriers. With that kind of construction of the modular plug, each contact carrier must be turned during processing, or in other words when the cable leads are connected to the applicable contact row. Moreover, in a modular plug with an uneven number of contact rows, one and two-row contact carriers are required.

A cable plug known from FIG. 4 of U.S. Pat. No. 4,550,960 likewise has a modular plug with a plurality of two-row contact carriers, between which insulation interlays are inserted for securing the contacts.

SUMMARY OF THE INVENTION

It is accordingly an object of the invention to provide a cable plug for multi-lead cables, which overcomes the hereinafore-mentioned disadvantages of the heretofore-known devices of this general type, which simplifies the structure of the modular plug and which optimizes the contact carriers of the modular plug so that a connection of the cable leads can be carried out in a rational way.

With the foregoing and other objects in view there is provided, in accordance with the invention, a cable plug for multi-lead cables, comprising a plug housing which in particular is conductive; a device for connecting a cable with individual cable leads to the plug housing; and a multi-part modular plug inserted into the plug housing, the modular plug having individual plate-like contact carriers made of insulating material including a first and a last contact carrier, the contact carriers having front and rear outer sides, the contact carriers each having a respective single contact row for connecting the individual cable leads, the contact rows being formed by insulation displacement connection (IDC) contacts and each being disposed on the front side of a respective one of the contact carriers, the contact carriers being fitted, hammered or pushed in succession onto the cable leads, being stacked with the contact carriers resting on one another, and being mutually locked in a plugging direction and crosswise thereto to form a contact block with the front side of the last contact carrier being exposed, except for the first contact carrier, the rear sides of the contact carriers without the contact rows each being disposed between the contact row on the front side of a respective one of the contact carriers and the contact row on the front side of an adjacent one of the contact carriers, and the contact block being insulated from the plug housing at least at the exposed or open front side of the last contact carrier and being held and locked in the plug housing.

In this kind of cable plug, the modular plug includes a plurality of single-row, identically constructed or in other words uniform contact carriers that are stacked on one another in such a manner as to be secure against shifting. This is advantageous in several respects. It lends the modular plug a simple structure which is advantageous especially from the standpoint of assembly and connection, and it enables rational connection of the cable leads. Since single-row, identically constructed contact carriers are used, the modular plug has a simple, economical construction regardless of the number of its contact rows, even if there is an uneven number of contact rows, because there is no need to use different versions of contact carriers. Processing, that is the connection of the cable leads or packaging, can be performed from the same direction with all of the contact carriers of one modular plug, without having to turn the contact carrier. This makes it possible to reduce the number of errors as well as the number of manipulating and processing operations. In the packaging, the cable leads are first driven, by means of a special tool, into a first contact carrier that is pre-assembled with the IDC contacts. The other contact carriers are then connected in succession in the same way. After the packaging, the contact carriers need not be rotated or displaced relative to one another, so that mechanical strains on the contact points are avoided. Since the spacing between the contact points and the cable fastening to the connection device can be precisely predetermined, no mechanical warping occurs in the finished plug. The contact carriers, which are still fanned out widely after packaging, can then be simply stacked to make a stable contact block and inserted into the plug housing. Gentle handling during assembly as the contact carriers are stacked on one another is assured, and the possibility that the various cable leads might mistakenly be crushed is averted.

In the state of the contact carriers in which they are stacked on one another to make a contact block, the open sides of the IDC contacts do not point toward one another, so that they are reliably electrically separated by the intervening contact-free rear side of the contact carriers, and additional insulating interlays between the individual contact carriers are not needed. The processing tool to be used for the packaging can be simple in construction, and the contact carriers all fit into one tool receptacle. The structure of the modular plug, including identically constructed contact carriers that can be stacked on one another, is also highly advantageous whenever individual contacts might be defective and need to be repaired. To that end, the contact block can be removed from the plug housing without difficulty. The individual contact carriers that are stacked on one another can then be fanned out widely, so that each contact is readily visible and easily accessible and can be easily replaced.

In a cable plug according to the invention, the contact block that forms the modular plug is insulated, at least on the open side or in other words on the front side of the last contact carrier, from the conductively constructed plug housing.

In accordance with another feature of the invention, the insulation between the contact block and the plug housing includes a plate-like insulator part, which holds the contact carriers together in a state in which they are stacked to make a contact block.

In accordance with a further feature of the invention, the plate-like insulator part has two long edges being parallel to one another and extending in the plugging direction, on which it has side ribs with which it can be interlocked with the side walls of a further insulator part of approximately U-shaped cross section and put together to make a contact block casing.

In accordance with an added feature of the invention, the insulator parts of the contact block casing perform other functions and the insulator parts, in the region of their plug end, are provided with polarizing and encoding means.

In accordance with an additional feature of the invention, the insulator parts have outer surfaces, and the polarizing and encoding means are formed by ribs and grooves extending in the plugging direction on the outer surfaces of the insulator parts, and by strips being separately insertable into the grooves.

In accordance with yet another feature of the invention, the contact block has closed lateral surfaces.

In accordance with yet a further feature of the invention, the contact carriers each have protrusions on the front side engaging into corresponding recesses formed in the rear side of an adjacent one of the contact carriers, for locking in the plugging direction and in the crosswise direction.

In accordance with yet an added feature of the invention, the protrusions for locking the contact carriers are formed by ribs in the vicinity of the contact row on the front side of the contact carriers, and the recesses are formed by corresponding slits in the rear side of the contact carriers.

In accordance with yet an additional feature of the invention, the contact carriers have mutually parallel open channels on the front side for the insulation displacement connection contacts and closed channels extending toward a plugging side in alignment with the open channels.

In accordance with again another feature of the invention, the plug housing has two half-shells with approximately U-shaped cross sections, and the contact block with the insulation is inserted as a whole into one of the half-shells and locked therein.

In accordance with a concomitant feature of the invention, the plug housing is constructed in one piece and has an open end surface, and the contact block with the insulation is thrust into the open end surface of the plug housing.

Other features which are considered as characteristic for the invention are set forth in the appended claims.

Although the invention is illustrated and described herein as embodied in a cable plug for multi-lead cables, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Description of the Preferred Embodiments

Figure 1:
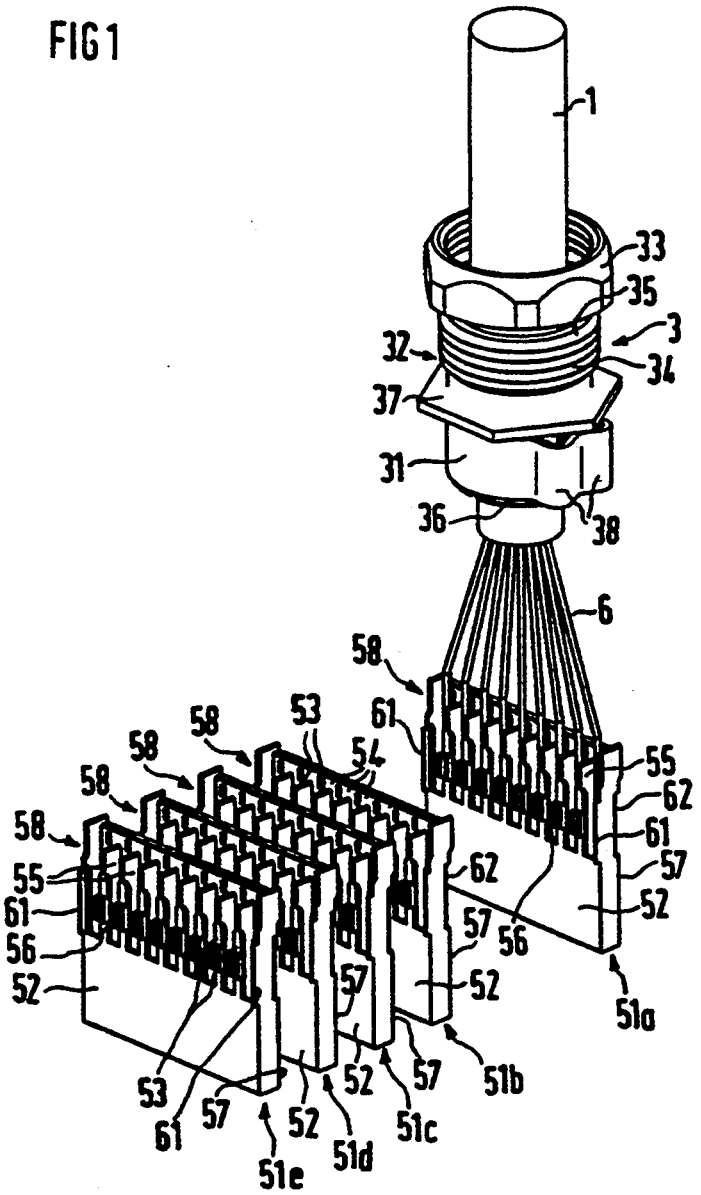
Fig. 1 is a perspective, diagrammatic, partly exploded view of structure of a modular plug including individual contact carriers, in which a first contact carrier has already been connected to leads of a shielded, multiple-lead cable.
Figure 5:
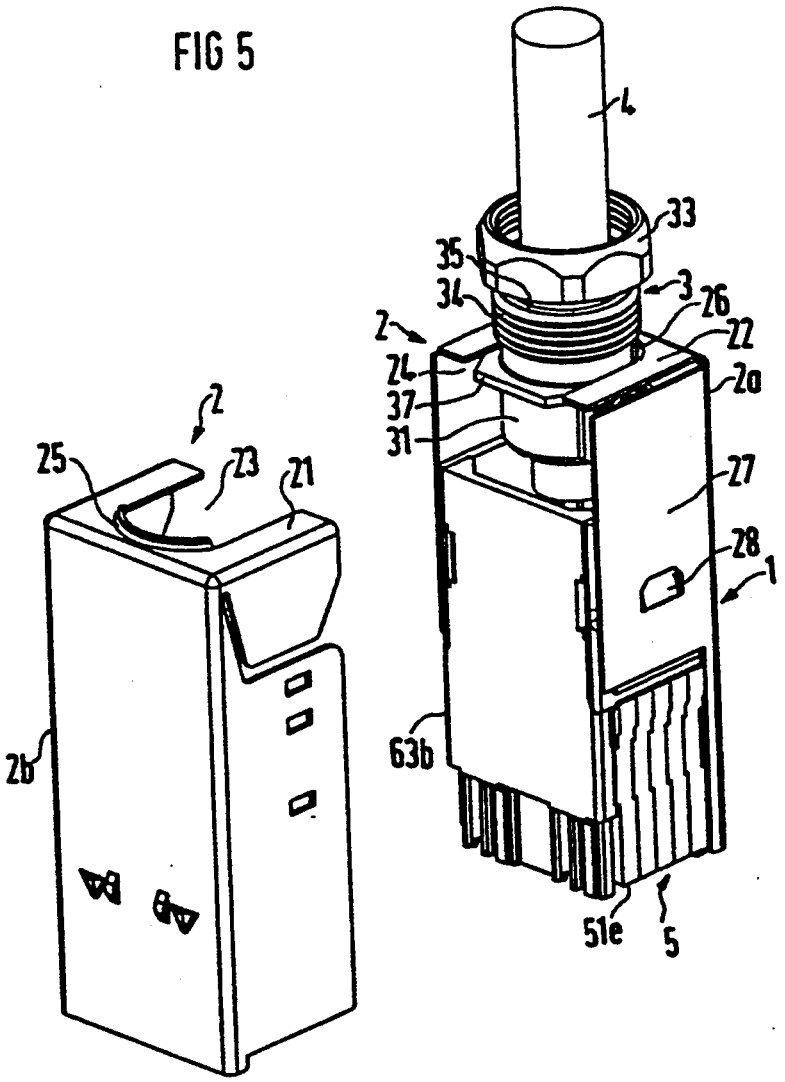
FIG. 5 is a similar view of a plug housing of the cable plug with the modular plug inserted and with the cable connected, before a housing cap is mounted on it.

Referring now to the figures of the drawing in detail and first, particularly, to FIG. 5 thereof, there is seen a shielded cable plug 1 which includes a conductively constructed plug housing 2, a device 3 for connection of a multi-lead cable 4, and a multi-part modular plug 5 inserted into the plug housing 2 for connecting individual cable leads 6 shown in FIG. 1.

The plug housing 2 is assembled, for instance, from two metal half-shells **2*a* and 2*b* having a U-shaped cross section, which are suitably formed as sheet-metal stamped, bendable parts. On a cable introduction side, the half-shells 2*a* and 2*b* are each constructed with one respective end wall 21 and 22 shown in FIG. 5, each having one respective recess 23 and 24 being provided in that end wall and being open toward the other half-shell for the introduction of the cable connection device 3. The recesses 23, 24 are provided in the form of oblong slots in the end walls 21, 22 which are perpendicular to the plugging direction in this case, and curved ends of the recesses 23, 24 are each surrounded by a respective collar 25, 26 protruding from the respective end wall. As FIG. 5 shows, the modular plug 5 is introduced into the one half-shell 2*a* with the cable 4 connected through the cable connection device 3, while the other half-shell 2*b* acts as a cap to close the plug in shielded fashion, in the state mounted on the half-shell 2*a*. As the drawings show, the cap connection device 3 includes an annular crimp element 31, a metal support sheath 32 best seen in FIG. 4 that can be slipped over the cable 4, and a relatively flat, likewise metal union nut 33. One end of the support sheath 32 is constructed with a threaded part 35 having an external thread 34 that is intended to be screwed to the union nut 33, and another end of the support sheath 32 has a slit contact part 36 for the cable shielding, with the slit contact part having internal threads. The support sheath 32 has a radially protruding flange 37 between the threaded part 35 and the contact part 36, which has a hexagonal circumferential shape, particularly when the support sheath is made of a hexagonal material. A wrench width of the flange 37 is larger than the inside diameter, or in this case the width, of the recesses 23, 24 provided in the end walls 21, 22 of the plug housing 2**.

The cable connection device 3 is premounted to the cable 4 in a separate assembly step. To that end, the support sheath 32 together with the union nut 33 is slipped over the insulated cable 4 and screwed to the cable jacket with the internal threads of the contact part 36. The cable shielding is then turned up, the annular crimp element 31 is slipped over it and is further compressed at two deformed points 38 by means of simple pliers, for instance, and clamped. As a result, the crimp element 31 presses the cable shielding firmly onto the contact part 36, which penetrates farther into the cable jacket with its internal threads, until the slits are closed and a closed diameter results. The cable is thus prepared for the connection of its leads 6 to the modular plug 5 and for insertion into the plug housing.

Figure 2:
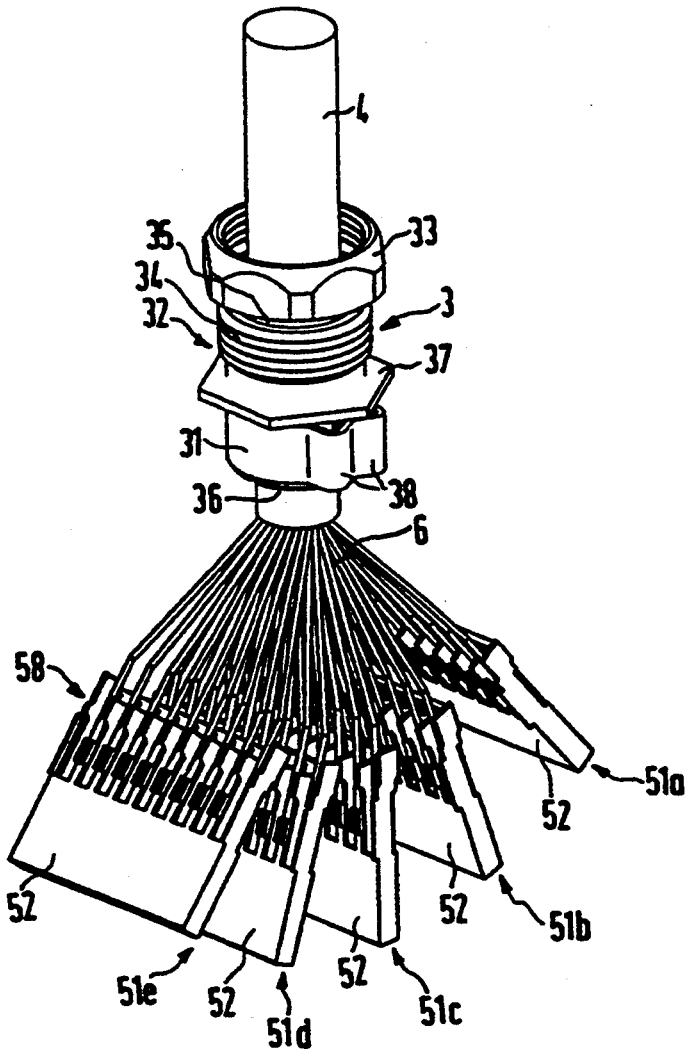
FIG. 2 is similar view of the modular plug with the contact carrier still fanned out widely, but with the lead connection of all of the contact carriers already completely packaged.
Figure 3:
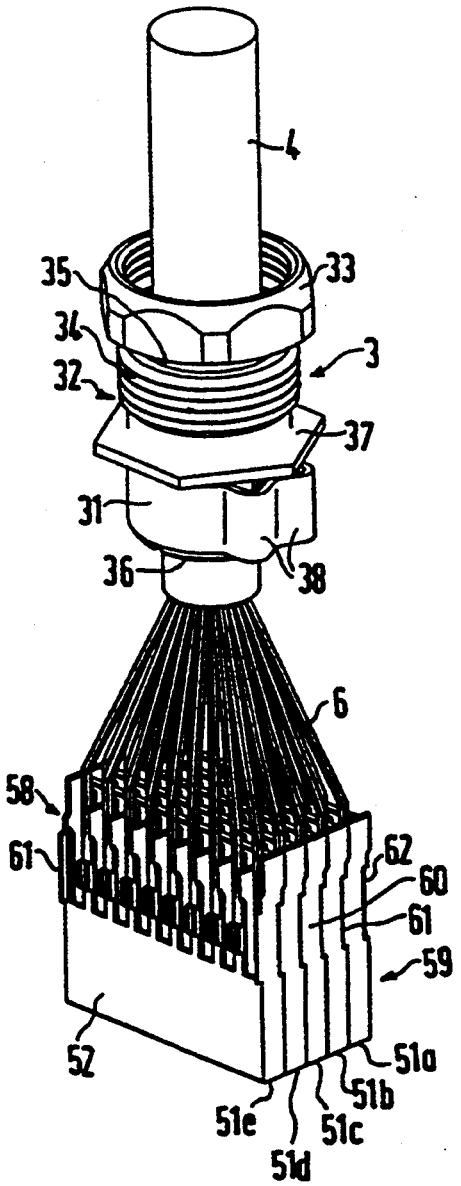
FIG. 3 is a similar view of a contact block formed of the individual stacked-together contact carriers of the modular plug.

The modular plug 5 is constructed in modular fashion from a plurality of contact carriers of insulator material, which are provided with contacts disposed in rows for the connection of the individual cable leads 6. In the exemplary embodiment shown, the modular plug 5 has five contact carriers 51*a*, 51*b*, 51*c*, 51*d* and 51*e* shown in FIGS. 1–3, which are plate-like in structure and are each provided with a single contact row 58. The contact carrier 51*a* is the first contact carrier and the contact carrier 51*e* is the last contact carrier. All of the contact rows 58 of the modular plug 5 are disposed on the same outer side of the contact carriers 51*a*–51*e*, namely on a front side 52 of the individual contact carriers that is oriented toward the observer of the drawings. The contact rows 58 are each formed of open channels 53, extending parallel to one another in the plugging direction and being provided in the upper half of the contact carrier, which are introduced into non-illustrated IDC (insulation displacement connection) contacts and anchored in small holes 54 and by closed channels being aligned with these channels and extending toward the plugging side within the material thickness of the contact carriers. In the exemplary embodiment shown, one contact row has nine channels 53 with pre-assembled IDC contacts. The open channels 53 are formed by parallel partitions 55 having a lower end from which two small parallel ribs 56 each protrude, before the beginning of the closed channels. Correspondingly, at the level of these ribs, rear sides 57 of the contact carriers 51*a*–51*e* are constructed with two non-illustrated slits which can be engaged by the ribs 56 of an adjacent contact carrier. The ribs 56 and the corresponding slits serve as mutual locking means of the contact carriers 51*a*–51*e* which are later assembled to make a modular plug, with the locking means acting in the plugging direction and crosswise thereto. Before the cable leads 6 are connected to the contact carriers 51*a*–51*e*, the latter are aligned as is shown in FIG. 1, in such a way that the front side of each of them faces the observer of FIG. 1. In other words, the front side 52 of the first contact carrier 51*a*, for instance, which is provided with the contact row 58, faces the contactless rear side 57 of the second contact carrier 51*b*. The same is true for the other contact carriers 51*b* and 51*c*; 51*c* and 51*d*; and 51*d* and 51*e* that are next to one another. This precludes the open contacts of the contact row of one contact carrier from facing the contact row of an adjacent contact carrier in an unsecured fashion. In order to connect the cable leads, nine leads 6, for instance, are then driven into the first contact carrier 51*a*, or its IDC contacts as is shown in FIG. 1, by means of a special tool. The connection of a second group of leads to the second contact carrier 51*b* follows, and the connection of the further contact carriers 51*c*, 51*d* and 51*e* successively ensues, until all of the rows of contacts, in this case five rows of contacts each with nine leads, have been connected. In this way, a multi-lead cable, for instance a 45-lead cable, is connected to the contact carriers 51*a*–51*e* of the modular plug 5. Due to the advantageous structure of the modular plug, the connection of a number of leads can be performed in a rational way. After the connection of the cable leads, the result is then a cable end that is largely prepared for connection, and in which the contact carriers 51*a*–51*e* of the modular plug 5 are first still widely fanned out, and the lead connections are therefore still readily visible and readily accessible, as is shown in FIG. 2. The contact carriers 51*a*–51*e* are then simply successively stacked on one another in modular fashion, so that they form a compact, closed contact block 59, having contact carriers which rest directly on one another, as FIG. 3 shows. Since one contactless rear side 57 of a contact carrier is then located between the contact row 58 on the front side 52 of one contact carrier and the contact row 58 on the front side 52 of an adjacent contact carrier, the open contacts are secured relative to one another, so that insulating interlays between the individual contact carriers are not required. In the state in which they are assembled into a contact block 59, the stacked contact carriers 51*a*–51*e* are also mutually locked in the plugging direction and transversely thereto, since then the ribs 56 of one contact carrier engage the respective slits on the rear side of the adjacent contact carrier in front of it. The contact block 59 also has closed lateral surfaces 60, which in this case are each formed by narrow, graduated side ribs 61 that are provided on two mutually parallel longitudinal edges on the front side of the individual contact carriers, with the edges extending in the plugging direction. These side ribs 61 engage corresponding indentations 62 on the rear side 57 of an adjacent contact carrier, to avoid air gaps and creepage paths. It is only on the front side, toward the observer of FIG. 3, that the contact block 59 is open, since the contacts on the front side 52 of the contact carrier 51*e* are not covered.

As can be seen particularly from FIGS. 2 and 3, the contact block 59 shown in FIG. 3 can be spread apart again just as easily as it was assembled, so that the contact rows 58 of the individual, spread-out contact carriers 51*a*–51*e* shown in FIG. 2 are readily accessible for any possible replacements of contacts that may become necessary.

Figure 4:
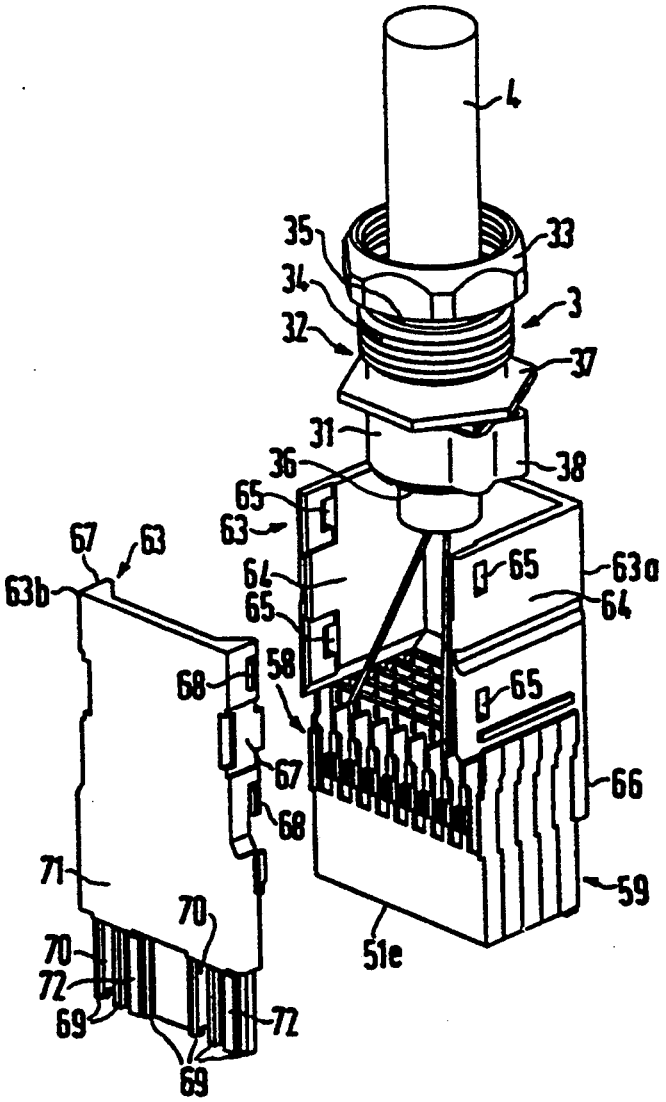
FIG. 4 is similar view illustrating a reception of the contact plug in an insulating contact block casing.

As FIG. 4 shows, the contact block 59 shown in FIG. 3 is received in a contact block casing 63, which includes a first insulator part 63*a* of approximately U-shaped cross section and a plate-like second insulator part 63*b*. The first insulator part 63*a* has two side walls 64, which are each provided with two detent holes 65 in the vicinity of ends of front longitudinal edges thereof. The first insulator part 63*a* also has a back wall 66 that extends beyond the side walls 64, for supporting the contact block 59. To that end, the inner surface of the back wall 66 that is oriented toward the contact block is constructed like the front side of the contact carriers 51*a*–51*e* with ribs of its own corresponding to the ribs 56. The ribs of the inner surface of the back wall 66 then engage the slits on the rear side 57 of the first contact carrier 51*a*. The second, plate-like insulator part 63*b* then acts as a cover for the open side of the contact block, or in other words as a covering of the open contacts of the last contact carrier 51*e*, and at the same time as a cap of the contact block casing 63. The second insulator part 63*b* has side ribs 67 on two mutually parallel long edges extending in the plugging direction. Each of the side ribs 67 has two detent protrusions 68 which are disposed in such a way as to match the position of the detent holes 65 of the first insulator part 63*a*. When the two insulator parts 63*a* and 63*b* are joined together to make the contact block casing 63, these detent protrusions 68 snap into the detent holes 65. The contact block 59 is then held together and covered in insulating fashion on its open side by the second insulator part 63*b*.

As can be seen from the insulator part 63*b* in FIGS. 4 and 5, the two insulator parts 63*a* and 63*b* of the contact block casing 63 are provided with polarizing and encoding means as well, in the region of their plug-side (lower) end. These means are formed by ribs 69 and grooves 70 extending in the plugging direction, on an outer surface 71 of the insulator part 63*b* and on an outer surface of the back wall 66 of the insulator part 63*a*, and by strips 72 that can be separately inserted into the grooves.

As FIG. 5 shows and has already been mentioned at the outset, the contact block 59 and the casing 63 form the complete modular plug 5, which is inserted as a whole with the multi-lead cable 4 connected through the cable connection device 3, into the half-shell 2*a* of the plug housing 2. The modular plug 5 is locked in the half-shell 2*a*, for instance by means of detent tongues 28 that are cut inward into the side walls 27 of the half-shell. The cable 4, which is premounted with the cable connection device 3, is introduced into the half-shell 2*a* in such a way that the flange 37 of the support sheath 32 is located inside this half-shell, or in other words below its end wall 22. After the half shells 2*a* and 2*b* have been put together, the union nut 33 is then screwed tight, so that the end walls 21, 22 of the assembled or put-together half-shells 2*a* and 2*b* of the plug housing 2 are firmly fastened between the flange 37 of the support sheath 32 and the union nut 33 screwed onto the threaded part 35 of the support sheath. The mechanical connection between the plug housing 2 and the cable connection device 3 is thus established, and because of a corresponding clear outer width of the two diametrically opposed collars 25, 26, the union nut 33 fits over this collar. Moreover, when the union nut 33 has been screwed tight, contacting of the cable shielding on the plug housing 2 is established.

When the half-shells 2*a* and 2*b* have been put together to make the plug housing 2, the contact row 58 covered by the second insulator part 63 on the front side 52 of the last contact carrier 51*e* is then insulated from the conductively constructed plug housing 2 and thus secured.

In contrast to the exemplary embodiment shown, the plug housing may also be constructed in one piece. In that case, the contact block with the insulator is then inserted into the open end surface of the plug housing.

We claim:

1. A cable plug for multi-lead cables, comprising:

a) a plug housing;

b) a device for connecting a cable with individual cable leads to said plug housing; and c) a multi-part modular plug inserted into said plug housing, said modular plug having individual plate-like contact carriers made of insulating material including a first and a last contact carrier, said contact carriers having front and rear outer sides, said contact carriers each having a respective single contact row for connecting the individual cable leads, said contact rows being formed by insulation displacement connection contacts and each being disposed on said front side of a respective one of said contact carriers, said contact carriers being fitted in succession onto the cable leads, being stacked with said contact carriers resting on one another, and being mutually locked in a plugging direction and crosswise thereto to form a contact block with said front side of said last contact carrier being exposed, except for said first contact carrier, said rear sides of said contact carriers without said contact rows each being disposed between said contact row on said front side of a respective one of said contact carriers and said contact row on said front side of an adjacent one of said contact carriers, and said contact block being insulated from said plug housing at least at said exposed front side of said last contact carrier and being held and locked in said plug housing.

2. The cable plug according to claim 1, including insulation disposed between said contact block and said plug housing, said insulation including a plate-like insulator part holding said contact carriers together in the stacked condition to make said contact block.

3. The cable plug according to claim 2, including a further insulator part having an approximately U-shaped cross section and side walls, said plate-like insulator part having two long edges being parallel to one another, extending in the plugging direction and having side ribs on said long edges for interlocking said plate-like insulator part with said side walls of said further insulator part and putting said insulator parts together to make a contact block casing.

4. The cable plug according to claim 2, wherein said plate-like insulator part has a plug end and polarizing and encoding means in the vicinity of said plug end.

5. The cable plug according to claim 3, wherein said insulator parts have plug ends and polarizing and encoding means in the vicinity of said plug ends.

6. The cable plug according to claim 4, wherein said plate-like insulator part has an outer surface, and said polarizing and encoding means are formed by ribs and grooves extending in the plugging direction on said outer surface of said insulator part, and by strips being separately insertable into said grooves.

7. The cable plug according to claim 5, wherein said insulator parts have outer surfaces, and said polarizing and encoding means are formed by ribs and grooves extending in the plugging direction on said outer surfaces of said insulator parts, and by strips being separately insertable into said grooves.

8. The cable plug according to claim 1, wherein said contact block has closed lateral surfaces.

9. The cable plug according to claim 1, wherein said contact carriers each have protrusions on said front side engaging into corresponding recesses formed in said rear side of an adjacent one of said contact carriers, for locking in the plugging direction and in the crosswise direction.

10. The cable plug according to claim 9, wherein said protrusions for locking said contact carriers are formed by ribs in the vicinity of said contact row on said front side of said contact carriers, and said recesses are formed by corresponding slits in said rear side of said contact carriers.

11. The cable plug according to claim 1, wherein said contact carriers have mutually parallel open channels on said front side for the insulation displacement connection contacts and closed channels extending toward a plugging side in alignment with said open channels.

12. The cable plug according to claim 1, including insulation disposed between said contact block and said plug housing, said plug housing having two half-shells with approximately U-shaped cross sections, and said contact block with said insulation being inserted as a whole into one of said half-shells and locked therein.

13. The cable plug according to claim 1, including insulation disposed between said contact block and said plug housing, said plug housing being constructed in one piece and having an open end surface, and said contact block with said insulation being thrust into said open end surface of said plug housing.

* * * * *